US006508509B2

(12) United States Patent
Peterson

(10) Patent No.: US 6,508,509 B2
(45) **Date of Patent: *Jan. 21, 2003**

(54) BACK FOR SEATING UNIT AND METHOD OF ASSEMBLY

(75) Inventor: Gordon J. Peterson, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/746,112

(22) Filed: Dec. 21, 2000

(65) Prior Publication Data

US 2002/0024243 A1 Feb. 28, 2002

Related U.S. Application Data

(63) Continuation of application No. 09/294,751, filed on Apr. 19, 1990, now Pat. No. 6,220,661.

(51) Int. Cl.[7] ..... A47C 7/24

(52) U.S. Cl. ..... 297/218.4; 297/226; 297/440.11; 297/440.2

(58) Field of Search ..... 297/218.1, 218.4, 297/228.1, 228.13, 226, 440.2, 440.4, 452.14, 452.15, 440.11

(56) References Cited

U.S. PATENT DOCUMENTS

| | | | |
|---|---|---|---|
| 1,820,104 | A | 8/1931 | Whaley |
| 1,825,909 | A | 10/1931 | Levi |
| 1,942,111 | A | 1/1934 | Levi |
| 2,572,689 | A | 10/1951 | Bell |
| 2,848,039 | A | 8/1958 | Lenz |
| 2,921,625 | A | 1/1960 | Krasnov et al. |
| 3,126,229 | A | 3/1964 | Dickerson |
| 3,174,797 | A | 3/1965 | Neufeld |
| 3,223,450 | A | 12/1965 | Pollock |
| 3,233,253 | A | 2/1966 | Cauvin |
| 3,567,278 | A | 3/1971 | Barecki et al. |
| 3,758,159 | A | 9/1973 | Morris |
| 3,871,041 | A | 3/1975 | Plume |
| 3,928,898 | A | 12/1975 | Smoot |
| 3,981,534 | A | 9/1976 | Wilton |
| 3,995,892 | A | 12/1976 | Hellman et al. |
| 4,036,524 | A | 7/1977 | Takamatsu |
| 4,103,968 | A | 8/1978 | Butterfield et al. |
| 4,153,293 | A | 5/1979 | Sheldon |
| 4,284,305 | A | 8/1981 | Porter et al. |
| 4,357,723 | A | 11/1982 | Zelkowitz |
| 4,408,797 | A | 10/1983 | Franck et al. |
| 4,465,534 | A | 8/1984 | Zelkowitz |
| 4,526,420 | A | 7/1985 | Kawamura et al. |
| 4,558,904 | A | 12/1985 | Schultz |
| 4,715,651 | A | 12/1987 | Wakamatsu |

(List continued on next page.)

FOREIGN PATENT DOCUMENTS

| | | | |
|---|---|---|---|
| GB | 709668 | 6/1954 | ..... 297/218.4 |

*Primary Examiner*—Peter R. Brown
(74) *Attorney, Agent, or Firm*—Price Heneveld Cooper DeWitt & Litton

(57) ABSTRACT

A seating unit illustrated as a mobile office chair includes a base, a back upright operably supported on the base for reclining movement and a back construction. The back construction includes a cushion assembly attached to a back support shell with quick-attach top and bottom connectors. Specifically, the back support shell includes top apertures, and the cushion assembly includes hooks for drop-in attachment to the top apertures. The back support shell also includes a molded bottom section defining a recess, and the back cover includes a stiffened edge flange configured to frictionally engage the recess to retain the back cover to the back support. The cushion assembly includes a cover assembly with an upholstered front panel, and a rear panel formed by a first sheet section having a one-directional stretch in a vertical direction, and a second section having a high-stretch property.

24 Claims, 7 Drawing Sheets

U.S. PATENT DOCUMENTS 4,789,201 A 12/1988 Selbert
4,805,962 A 2/1989 Sacco et al.
4,813,740 A 3/1989 Yon et al.
4,836,609 A 6/1989 Hill
4,844,546 A 7/1989 Hanai
4,867,507 A 9/1989 Arai
5,251,962 A 10/1993 Saito
5,352,021 A 10/1994 Kurczynski
5,401,075 A 3/1995 Venuto et al.
5,478,134 A 12/1995 Bernard et al.
5,499,859 A 3/1996 Angell
5,518,292 A 5/1996 Cozzani
5,518,294 A 5/1996 Ligon, Sr. et al.
5,549,355 A 8/1996 Illulian
5,560,677 A 10/1996 Cykana et al.
5,630,643 A 5/1997 Scholten et al.
5,718,478 A 2/1998 Allison
5,733,001 A 3/1998 Roberts
5,746,477 A 5/1998 Saul
5,758,924 A 6/1998 Vishey
6,050,646 A 4/2000 Stenzel et al.

BACK FOR SEATING UNIT AND METHOD OF ASSEMBLY

CROSS REFERENCES TO RELATED APPLICATION

This application is a continuation of commonly assigned, co-invented application Serial No. 09/294,751, filed Apr. 19, 1999, now U.S. Pat. No. 6,220,661, entitled CHAIR BACK AND METHOD OF ASSEMBLY.

BACKGROUND OF THE INVENTION

The present invention relates to back constructions for seating units optimally suited to provide a wrinkle-free appearance and that facilitate quick assembly. The present invention further relates to methods of assembly.

Recently, a new chair has been developed by Steelcase that includes a very flexible back construction adapted to flex significantly in the lumbar region of a seated user's back, and further that is biased in the lumbar region to provide good support to a seated user. The result is a very comfortable back that posturally supports a user as the user moves around in the chair. The back construction characteristically provides excellent postural support and characteristically minimizes shirt pull as a seated user moves between upright and reclined positions. A potential problem is that the back construction flexes to such an extent that it is difficult to eliminate wrinkles and looseness in upholstery covering the back construction in all flexed positions of the back construction, particularly as the back construction is flexed from a deep concave condition where the lumbar region protrudes forwardly, and is flexed toward a more planar condition where the lumbar region is more aligned with the thoracic and pelvic regions of the back construction. During this flexure, there is a significant change in vertical length along a front surface of the back construction as the back construction is flexed. The problem is further compounded by the need to have a competitive chair assembly process that minimizes parts, cost, and labor. Still further, the particular new chair design illustrated herein has a novel and attractive rear appearance of the back construction that, in many circumstances, is desirable not to hide or cover. Thus, an upholstery arrangement is desired that attaches to and is limited primarily to a front surface of the back construction, yet that is secure, durable, and closely retained to the back support structure to prevent looseness and bunching of the covering.

Accordingly, a back for seating unit and related method of assembly are desired that solve the aforementioned problems and have the aforementioned advantages.

SUMMARY OF THE INVENTION

In one aspect of the present invention, a seating unit includes a base, a back upright operably supported on the base for movement between an upright position and a reclined position, and a back construction. A back support is attached to the back upright and includes a cushion assembly attached to the back support. The back support also includes a bottom section defining a horizontally extending recessed channel. The cushion assembly includes a stiffened edge flange configured to frictionally engage the recessed channel to retain the cushion assembly to the back support along the bottom section of the back construction. The back support includes a flexible lumbar section that is constructed to flex between different vertical profiles providing different lumbar support. The cushion assembly further includes a back cushion that includes an aesthetic cover that covers at least a front side of the back cushion. The back support includes hooks, and the cushion assembly includes apertures for engaging the hooks for assembly.

In another aspect of the present invention, a seating unit includes a base, a back upright operably supported on the base for movement between an upright position and a reclined position, and a back construction. A back support is attached to the back upright and includes a cushion assembly attached to the back support. The back support includes a bottom section defining a horizontally extending recessed channel. The cushion assembly includes a stiffened edge flange configured to frictionally engage the recessed channel to retain the cushion assembly to the back support along the bottom section of the back construction. The cushion assembly further includes a back cushion and a cushion stiffener attached to the cushion. The cushion stiffener includes downwardly extending strips of material that stiffen lower side edges of the back cushion for edge support.

In another aspect of the present invention, a seating unit includes a base, a back upright operably supported on the base for movement between an upright position and a reclined position, and a back construction. A back support is attached to the back upright and includes a cushion assembly attached to the back support. The back support includes a bottom section defining a horizontally extending recessed channel and the cushion assembly includes a stiffened edge flange configured to frictionally engage the recessed channel to retain the cushion assembly to the back support along the bottom section of the back construction. The cushion assembly further includes a back cushion that includes a cushion stiffener attached to the back cushion. The cushion assembly includes a cover assembly comprising a pull-on sock, and wherein the pull-on sock is stapled to the cushion stiffener after assembly.

In another aspect of the present invention, a seating unit includes a base, a back upright operably supported on the base for movement between an upright position and a reclined position, and a back construction. A back support is attached to the back upright and includes a cushion assembly attached to the back support. The back support includes a bottom section defining a horizontally extending recessed channel and the cushion assembly includes a stiffened edge flange configured to frictionally engage the recessed channel to retain the cushion assembly to the back support along the bottom section of the back construction. The cushion assembly includes a back cushion and further includes a cover assembly constructed to be inverted and assembled onto the back cushion to cover the back cushion. The cover assembly includes a front panel covering a front surface of the back cushion, and further includes a rear panel that covers a rear surface of the back cushion. The rear panel includes fabric that characteristically stretches in a vertical direction at a rate of at least about twice an elongation of the fabric in a horizontal direction.

In another aspect of the present invention, a seating unit includes a base, a back upright operably supported on the base for movement between an upright position and a reclined position, and a back construction. A back support is attached to the back upright, and includes a cushion assembly attached to the back support. The back support further includes a bottom section defining a horizontally extending recessed channel and the cushion assembly includes a stiffened edge flange configured to frictionally engage the recessed channel to retain the cushion assembly to the back support along the bottom section of the back construction. The cushion assembly includes a back cushion and further includes a cover assembly constructed to be inverted and assembled onto the back cushion to cover the back cushion. The cover assembly includes a lower panel attached to a bottom edge of the rear panel, the lower panel including high-stretch material that elongates at least about 100 percent in a vertical direction. The lower panel includes material forming the stiffened edge flange.

In yet another aspect of the present invention, a seating unit includes a base, a back upright operably supported on the base for movement between an upright position and a reclined position, and a back construction. A back support is attached to the back upright and includes a cushion assembly attached to the back support. The back support includes a bottom section and the cushion assembly includes an elastically stretchable lower edge section stretched and attached to the bottom section of the back construction to pull a lower part of the cushion assembly downwardly. The cushion assembly further includes a back cushion and a cushion stiffener, the cushion stiffener including downwardly extending strips of material that stiffen the back cushion for edge support.

In still another aspect of the present invention, a construction for a seating unit includes a support shell configured to support a seated person. The support shell has a bottom section defining a horizontally extending recessed channel. A cushion assembly is attached to the support shell and includes a cushion and a cover assembly covering the cushion. The cover assembly has an elastic section with a stiffened edge flange configured to frictionally engage the recessed channel to retain the cushion assembly to the support shell along the edge section of the support shell. The cushion assembly further includes a back cushion and a cushion stiffener. The cushion stiffener includes downwardly extending strips of material that stiffen the back cushion for edge support.

In yet another aspect of the present invention, a seating unit includes a base, a back upright supported on the base, and a back support including relatively stiff thoracic and pelvic sections pivoted to the back upright at top and bottom connections, respectively. The seating unit further includes a flexible lumbar section located between the thoracic and pelvic sections. The back support includes a first top connector and a first bottom connector and a cushion assembly covering at least part of a front surface of the back support. The cushion assembly includes a second top connector engaging the first top connector on the back support and includes a second bottom connector engaging the first bottom connector on the back support. One of the first top and bottom connectors include a horizontally extending recessed channel and one of the second top and bottom connectors includes a stiffened edge flange configured to frictionally engage the recessed channel to retain the cushion assembly to the back support at a bottom thereof. The other of the first top and bottom connectors include at least one aperture and the other of the second top and bottom connectors include at least one hook engaging the at least one aperture.

In another aspect of the present invention, a back construction for a seating unit includes a back support shell shaped to support a seated user's back. The back support shell has a bottom edge with a horizontally elongated recessed channel formed proximate the bottom edge and includes hooks. A cover assembly covering a front of the back support shell includes an elongated stiffened bottom flange configured to fit into the recessed channel. The cover assembly further includes a cushion assembly incorporating a cushion stiffener with apertures engaging the hooks.

In yet another aspect of the present invention, a cover assembly includes an upholstered front panel of aesthetic material shaped to cover a front of a back of a seating unit. A rear panel is attached to the front panel along three adjacent edges of the rear panel. The front and rear panels form a sock that can be pulled over a cushion to cover the cushion. The rear panel is made in part from stretchable material, so that the rear panel can be stretched toward a fourth edge on the rear panel and secured along the fourth edge while the rear panel is in a stretched condition. A cushion is attached to the front panel and a cushion stiffener is attached to the cushion and has downwardly extending strips that stiffen the cushion for edge support.

In still another aspect of the present invention, a seating unit includes a base, a back upright operably supported on the base for movement between an upright position and a reclined position. A back construction includes a back support attached to the back upright and further includes a cushion assembly attached to the back support. The back support includes a bottom section defining a horizontally extending recessed channel and the cushion assembly includes a stiffened edge flange configured to frictionally engage the recessed channel to retain the cushion assembly to the back support along the bottom section of the back construction. The back support includes hooks, and the cushion assembly includes a cushion stiffener with apertures for engaging the hooks for assembly.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 2:
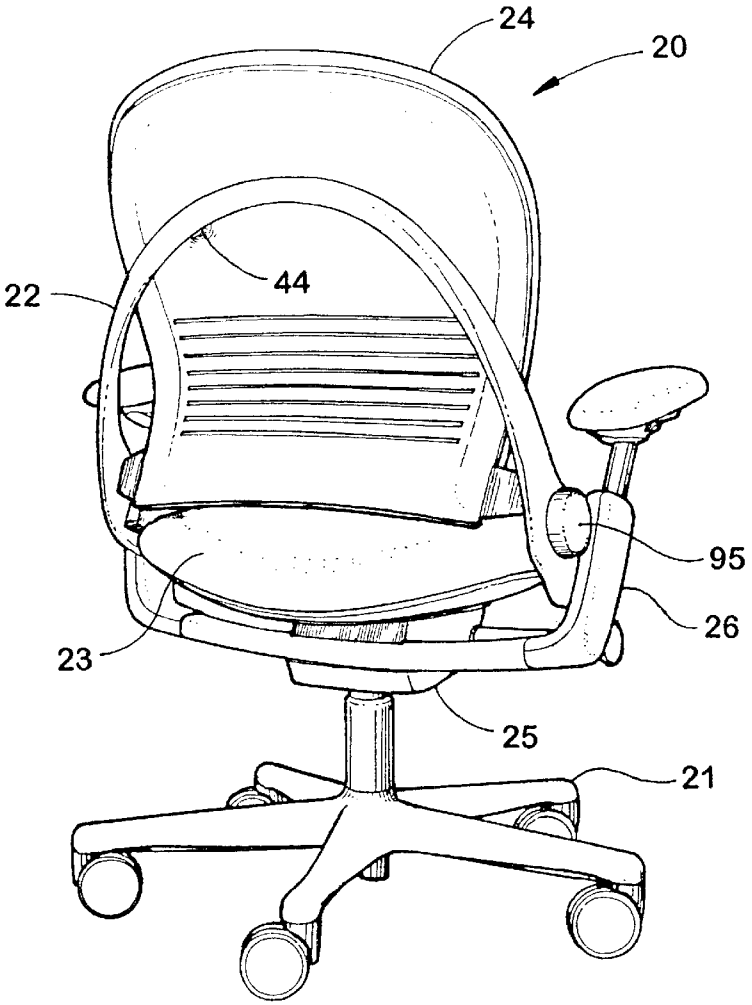
FIGS. 1 and 2 are front and rear perspective views of a seating unit embodying the present invention.
Figure 1:
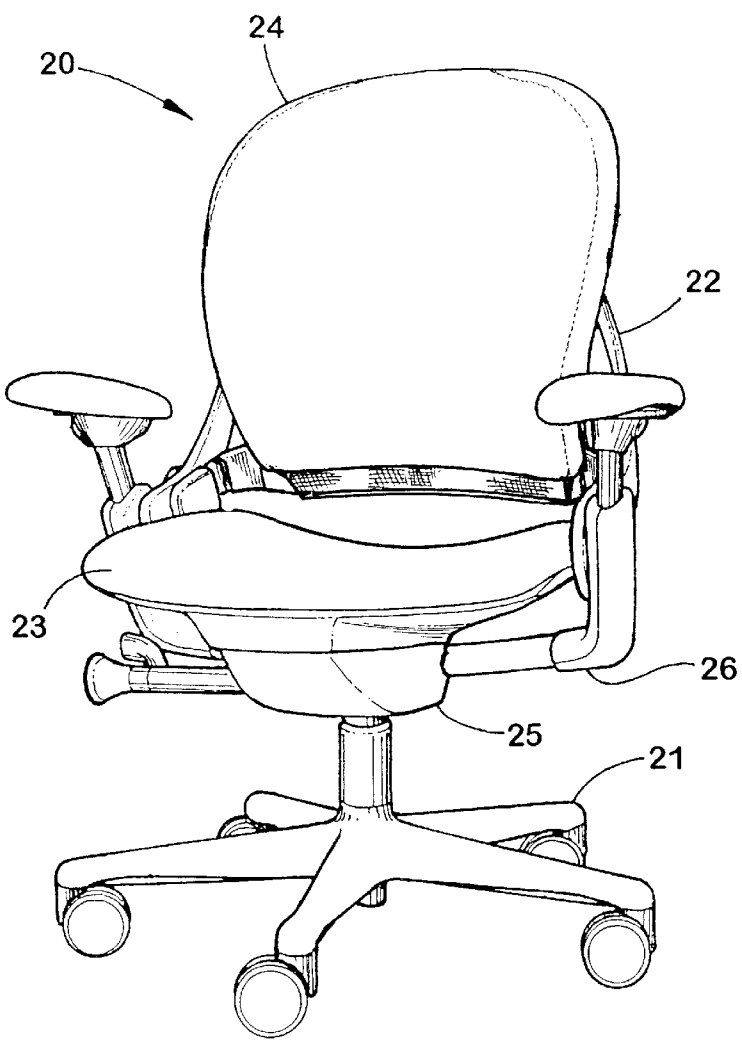
Figure 8:
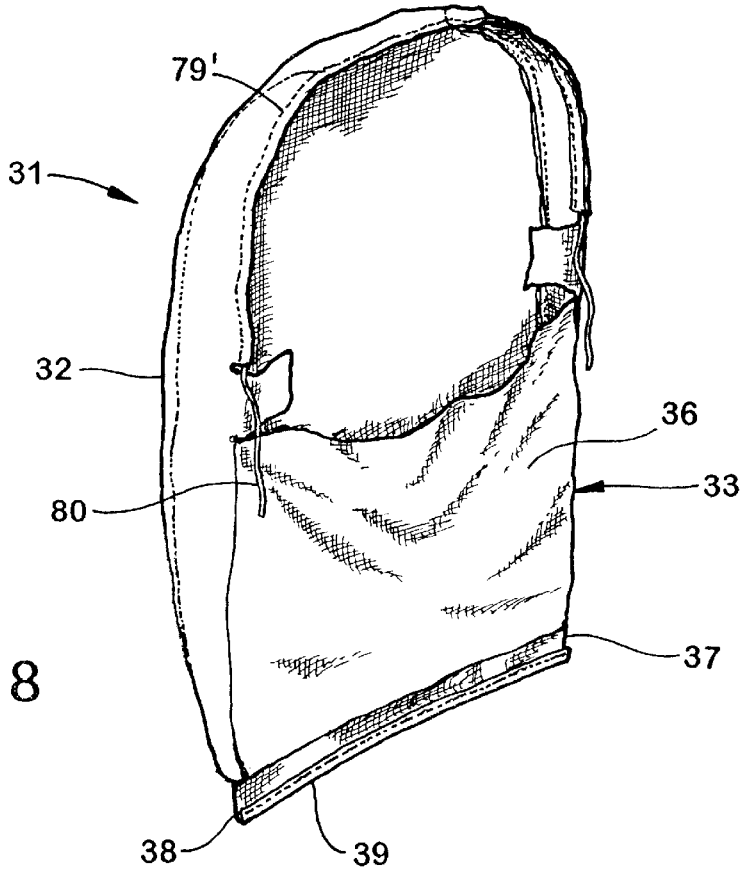
FIG. 8 is a perspective view of the cover assembly shown in FIG. 3.

A seating unit embodying the present invention includes a chair 20 (FIGS. 1 and 2) having a base 21, a back upright or arch-shaped back frame 22, a seat 23, and a back construction 24. The base 21 includes a control housing 25, with fixed side support structures 26 extending laterally and upwardly from the control housing 25. The back upright 22 is movable between an upright position and a reclined position. The back construction 24 (FIG. 3) includes a back support shell 27 (also referred to as a "back support") attached to the back upright 22 (FIG. 4), and further includes a cushion assembly 28 (FIG. 3) attached to the back support shell 27 with quick-attach hooking top connection 29 and a "zip-lock" type bottom connection 30. The cushion assembly 28 includes a cover assembly 31 (FIG. 8) having an upholstery front panel 32 and a rear panel 33 forming a sock that can be inverted and "pulled" upwardly onto a cushion 35 and cushion stiffener 34 as the cover assembly 31 is inverted. The rear panel 33 includes a first sheet/fabric section 36 having a one-directional stretch in a vertical direction, and further includes a lower second fabric section 37 having a high-stretch property. The second section 37 hangs downwardly from the front panel 32 and has a strip of stiff material 38 sewn along its lower edge to form the stiffened edge flange 39 noted below, which stiffened edge flange 39 forms part of the bottom connection 30. The stretchable second section 37, in combination with the other structure of top and bottom connections 29 and 30, allow for quick assembly, yet provide for a tensioned cover assembly 31 on the back construction 24 that tends to remain flat and unwrinkled, even with considerable flexure of the back construction 24 in the lumbar region of the back construction 24.

The present description of chair 20 is believed to be sufficient for an understanding of the present combination. Nonetheless, it is noted that a more detailed description of the chair 20 can be found in U.S. Pat. No. 5,871,258, issued Feb. 16, 1999, entitled *Chair with Novel Seat Construction*, and also in U.S. patent application Ser. No. 08/957,473, filed Oct. 24, 1997, entitled *Chair Including Novel Back Construction*, the entire contents of both of which are incorporated herein in their entirety by reference. It is to be understood that a scope of the present invention includes using the present attachment and construction methods in combination with different office chairs, but also in many other chairs and seating where upholstery covering is desired, such as in couches, lounge seating, mass transit seating, automotive or bus seating, and stadium seating, or also in other upholstery-covered furniture, such as padded desking furniture and the like, and also in non-furniture situations where upholstery or sheeting must be attached to a flexible or bendable component in a wrinkle-free manner.

Figure 3:
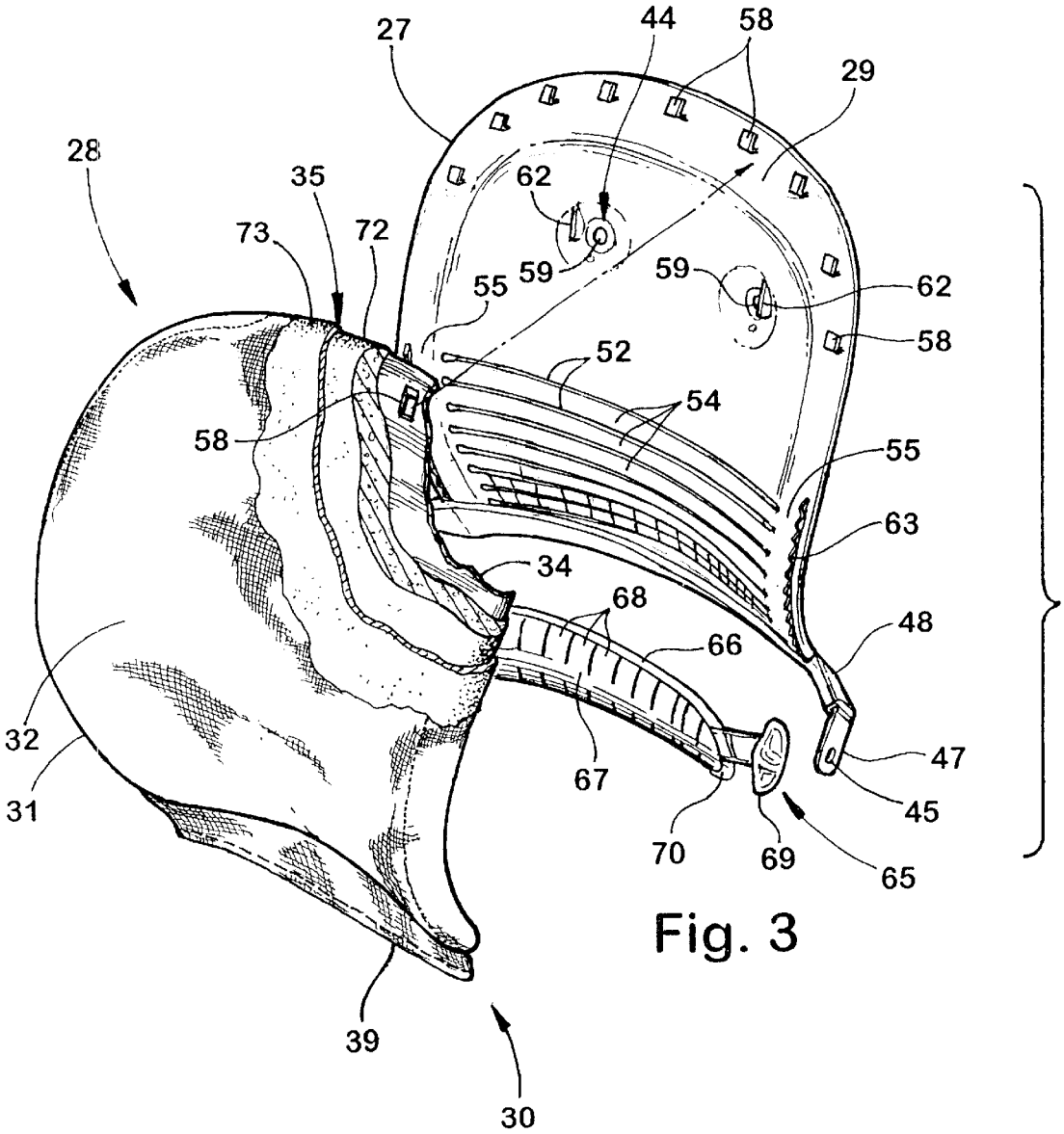
FIG. 3 is an exploded front perspective view of the back construction shown in FIG. 1.
Figure 4:
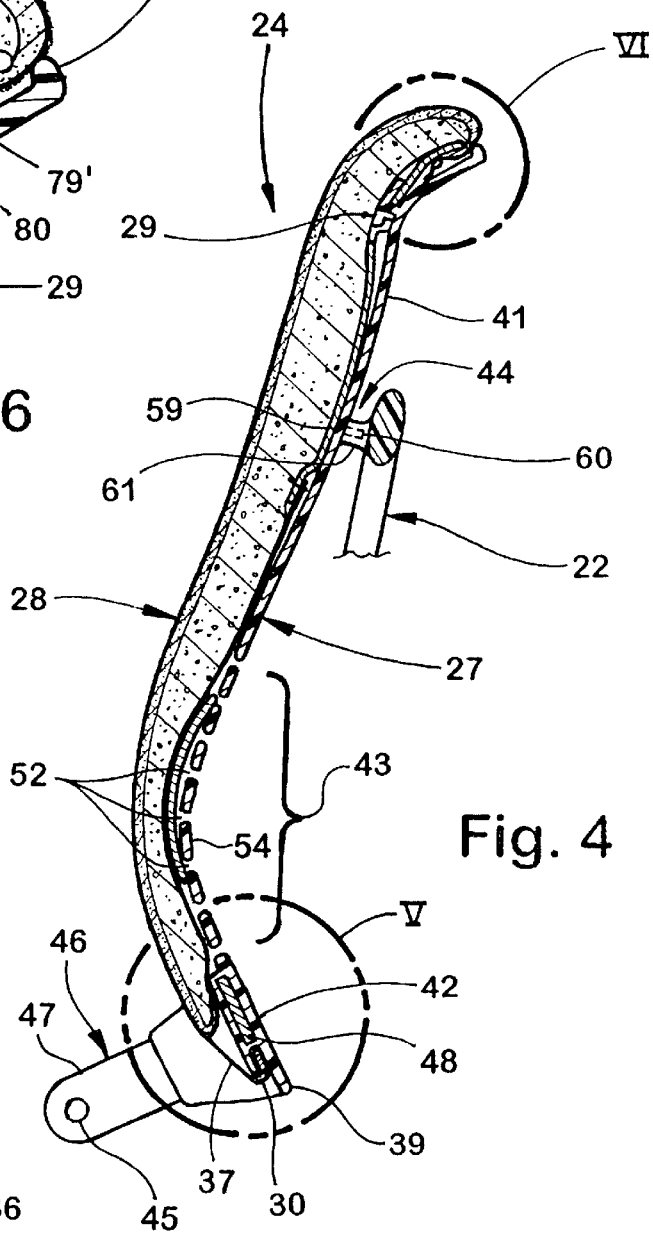
FIG. 4 is a vertical cross-sectional view taken through a center of the back construction shown in FIG. 1.

The back support shell 27 (FIG. 4) comprises a sheet of polypropylene material or similar engineering-type stiff structural material, and includes relatively stiff thoracic and pelvic sections 41 and 42 connected by a flexible lumbar section 43. The back support shell 27 is relatively stiff in a plane defined by the sheet, but is flexible in the lumbar section 43 in a direction perpendicular to the sheet. The thoracic and pelvic sections 41 and 42 are attached to the back frame 22 at top and bottom pivot locations 44 and 45, and the lumbar section 43 protrudes forwardly from the thoracic and pelvic sections 41 and 42. A belt bracket 46 extends parallel a lower edge of the pelvic section 42, and includes forwardly extending side flanges 47 each having a hole defining the bottom pivot location 45. The belt bracket 46 is encapsulated in an enlarged section 48 that extends along the lower edge of the pelvic section 42, and forms a horizontal recess 49 defined between a longer rear lip 50 and a shorter front lip 51. Slots 52 extend horizontally across a center area of the lumbar section 43 to form horizontal bands 54, but terminate short of the edges of the lumbar section 43 to define vertical side edge bands 55 (FIG. 3). The horizontal and vertical bands 54 and 55 are semi-flexible and designed to be sufficient in size and strength to provide the support desired. Due to the locations of top and bottom pivot locations 44 and 45 and also due to the shape and characteristics of the sections 41–43 and belt bracket 46, the back support shell 27 flexes significantly in the lumbar area, but rotates along a predetermined path a substantial amount around the bottom pivot location 45 and to a lesser extent around the top pivot location 44. This results is significant wrinkling of the upholstery material, unless the back construction 24 is constructed to compensate and make up for this high flexure, and the high compressing and stretching of the surfaces (i.e., the upholstery) in the lumbar section 43.

Figure 6:
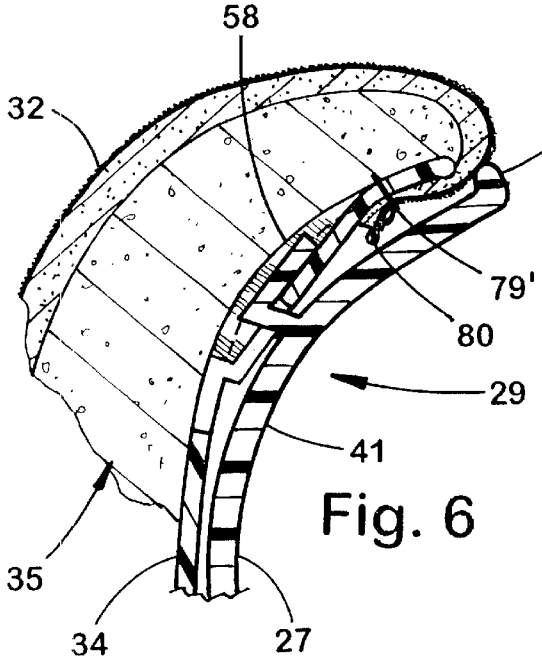
FIGS. 5 and 6 are enlarged views of the circled areas V and VI in FIG. 4.

The thoracic section 41 (FIG. 6) includes a ridge 57 along its upper edge and a series of hooks 58 spaced below the ridge 57 that project forwardly and then upwardly. A pair of apertures 59 is spaced below the hooks 58. The apertures 59 are positioned to receive screws 60 (FIG. 4) that extend rearwardly through the apertures 59 into threaded engagement with bosses 61 near a top of the arch-shaped back frame 22. The apertures 59 are recessed to create a rearwardly deformed pocket to receive a head of the screws 60 as desired. A pair of alignment stops 62' is located in the recesses on a front of the back support shell 27 adjacent apertures 59 to assist in assembly, as described below.

A pair of saw-tooth ridges 63 (FIG. 3) extends along a front face of the vertical bands 55 at a location near to but spaced inwardly from outer edges of the bands 55. A lumbar adjustment device 65 is positioned between the cushion assembly 28 and the back support shell 27. The lumbar adjustment device 65 includes a carrier 66, a lumbar support member 67 with vertical leaf-spring-like fingers 68 supported on the carrier 66, and a pair of side handles 69. The side handles 69 telescopingly engage mating structures 70 on ends of the carrier 66, and further include a channel for slidably engaging the saw-tooth ridges 63. A detent on the handles 69 engages the saw-tooth ridges 63 to hold the lumbar adjustment device in a selected vertical position.

Figure 7:
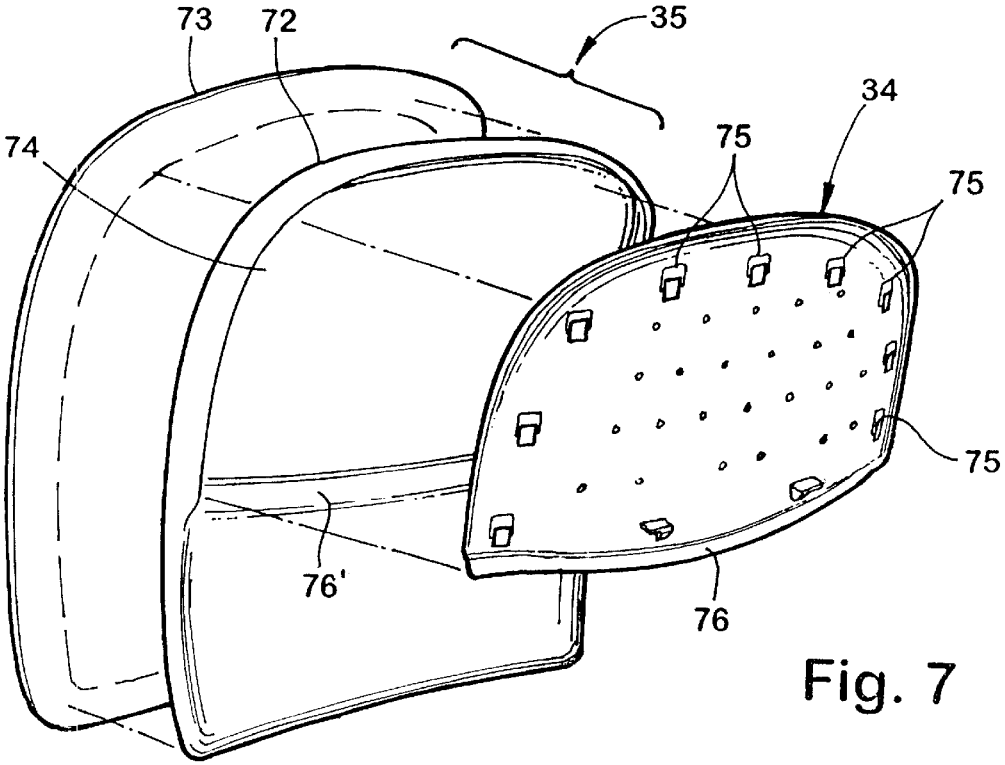
FIG. 7 is an exploded perspective view of the stiffened cushion subassembly shown in FIG. 3.

The cushion assembly 28 includes a back cushion 35 (FIG. 3) having a polyurethane foam main cushion 72 and a polyurethane foam topper cushion 73. The topper cushion 73 is added to provide a better initial support and feel to the assembly when a seated user initially leans against the cushion assembly 28. The cushion stiffener 34 comprises a stiff polypropylene panel. The main cushion 72 includes a rear surface shaped to mateably receive the cushion stiffener 34. An upper edge 74 (FIG. 7) on a rear surface of the main cushion 72 is wrapped over the upper edge 74 and onto a rear surface of the cushion stiffener 34. The cushion stiffener 34 is adhered to the main cushion 72 as needed to maintain the stability of the assembly desired. The cushion stiffener 34 includes a series of spaced-apart apertures 75 that correspond to the hooks 58 (FIG. 3). A horizontal down flange 76 (FIG. 7) extends along a lower edge of the cushion stiffener 34, which flange 76 is deformed inwardly toward the main cushion 72 at least a thickness of the material of rear panel 33, so that the rear panel 33 does not protrude outwardly when attached to the flange 76, as described below. The main cushion 72 has a recess 76 that mateably engages the flange 76.

Figure 5:
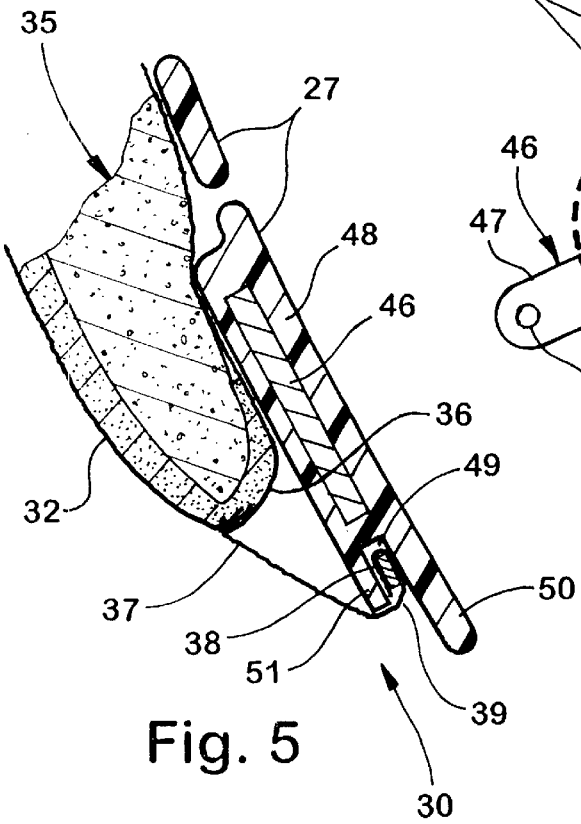

As noted above, the cover assembly 31 (FIG. 8) includes a front panel 32 and a rear panel 33. The front panel 32 includes sections of upholstery material sewn together to form the front and sides of a covering for the cushion 35. The rear panel 33 includes the first fabric section 36, which comprises a material that stretches horizontally only about five percent (5%), but that stretches vertically about forty percent (40%). The one-directional stretch material is available in commerce, such as from Milliken Company, Spartanburg, S.C. This first fabric section 36 is sized to extend from the mid-level horizontal flange 76 on the cushion stiffener 34 downwardly to a bottom of the cushion 35. The second section 37 is a high-stretch material having a stretchability of about one hundred percent (100%). This second section 37 is about two-inches high and extends across a bottom of the rear panel 33 of the cover assembly 31. A strip of stiffener material 38, such as polypropylene, is about ¼-inch wide in a vertical direction and is placed along a lower edge of the second section 37. The lower edge is folded over the strip 38 and sewn to the lower edge. This forms a stiffened edge flange 39 horizontally across the second section 37 that is optimally suited to be pressed or "zipped" into and frictionally retained in the horizontal recess 49 with a zip-lock like motion (see FIG. 5). Notably, the stiffened edge flange 39 is rectangular in shape and is rolled forwardly 180 degrees before it is inserted into the recess 49 (FIG. 5). This results in a surprisingly positive and secure bottom connection arrangement and one that can be quickly made by an assembler. The top rear edge of the front panel 32 (FIG. 6) is folded and sewn to form a tunnel 79', and a drawstring 80 is located in the tunnel. The front and rear panels 32 and 33 are sewn together to form an upwardly open sock. The panels 32 and 33 are initially sewn in an inverted position, and the cushion 35 is inserted into the sock as the sock in inverted. This also hides the seam lines where the panel 32 and first and second fabric sections 36 and 37 are sewn together.

Figure 9:
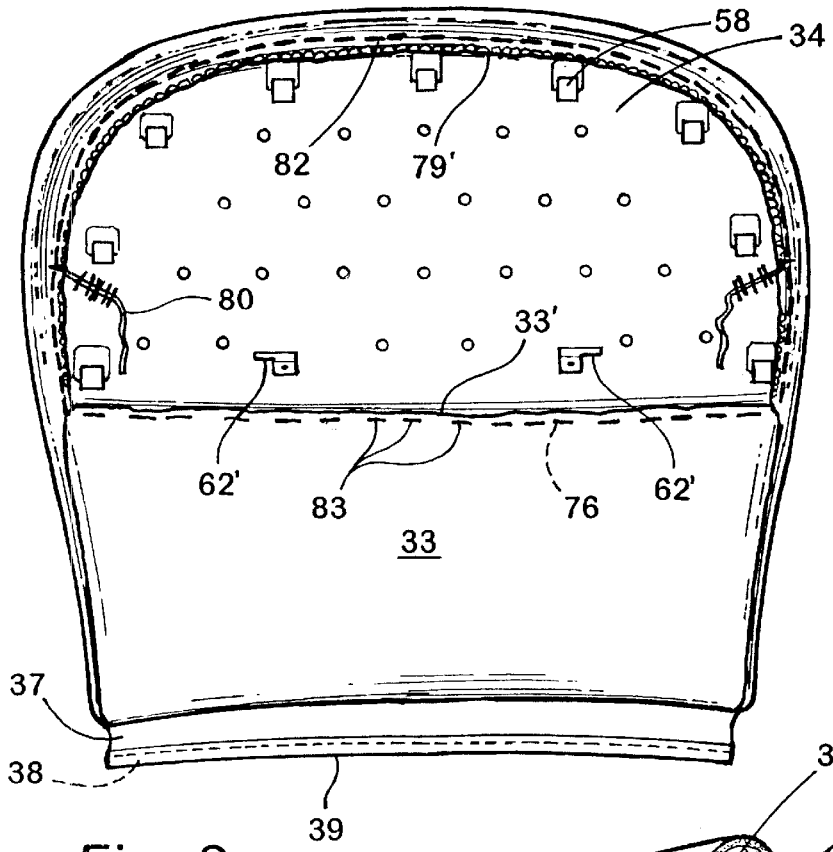
FIG. 9 is a rear view of the cushion assembly shown in FIG. 3, including the stiffened cushion subassembly and the cover assembly.
Figure 10:
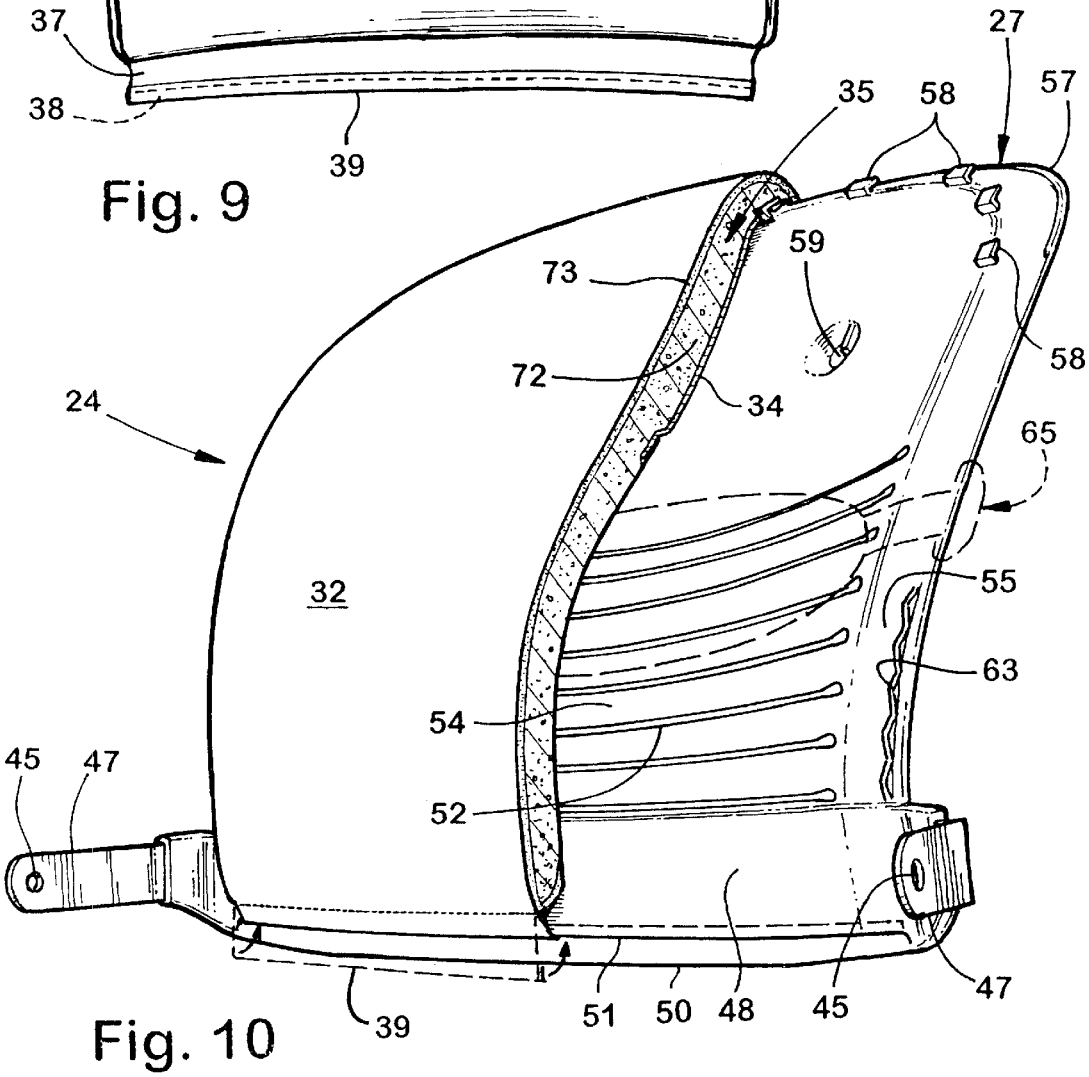
FIG. 10 is a front perspective view, partially broken away, showing the back construction of FIG. 3.
Figure 13:
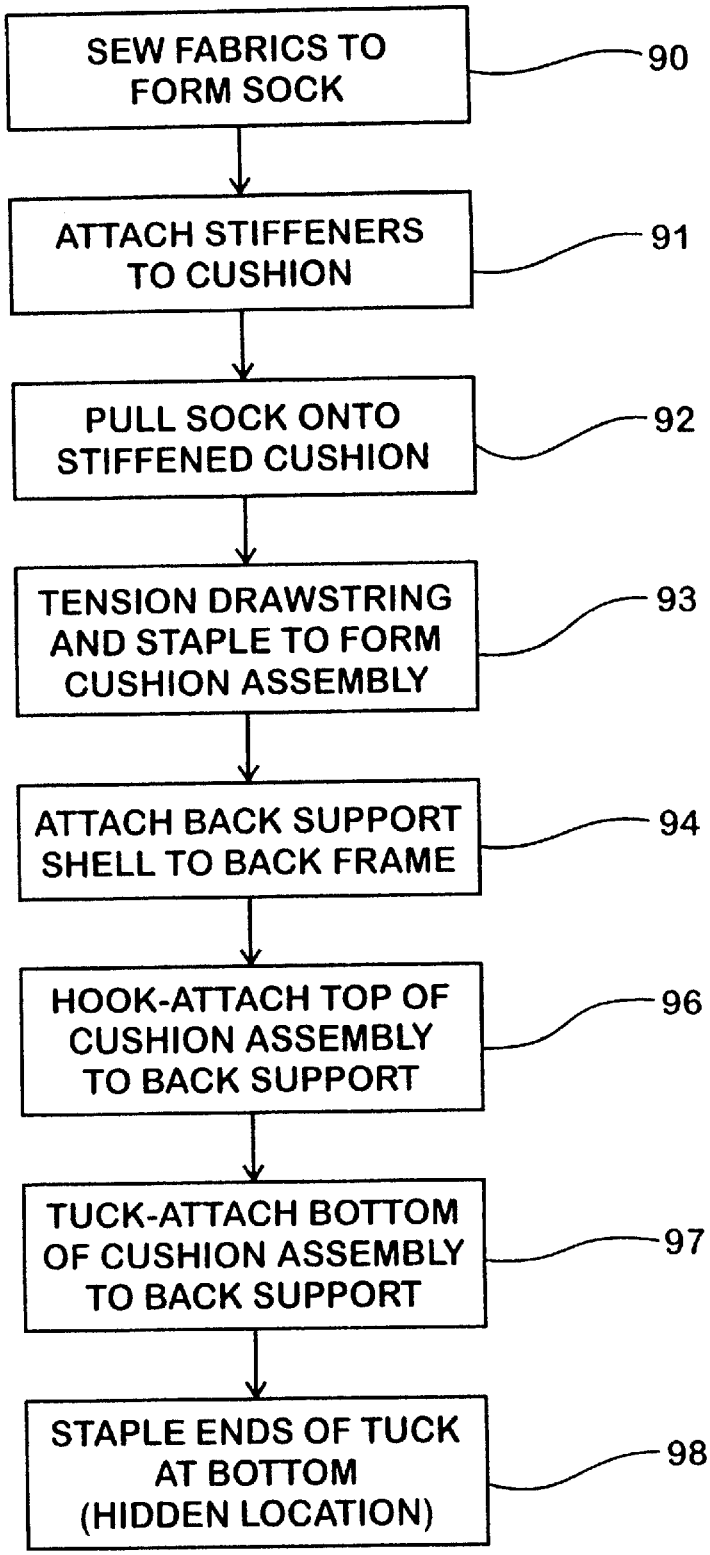
FIG. 13 is a flow diagram showing a method of assembly.

FIG. 13 discloses a method including forming a sock-like cover assembly 31 in a step 90 from the panels 32 and 33 and second fabric section 37. Step 90 further includes sewing a strip 78 to a bottom of second fabric section 37 and attaching a drawstring 80 in a tunnel 79'. A second step 91 includes attaching cushion stiffener 34 to the cushion 35. The cover assembly 31 is positioned adjacent the cushion 35 and inverted onto an end of the cushion 35 opposite the cushion stiffener 34 in a step 92. This results in the high-stretch second fabric section 37 being positioned at a lower edge of the cover assembly 31 remote from the cushion stiffener 34. The cover assembly 31 is then adjusted on the cushion 35 and cushion stiffener 34 to eliminate wrinkles and to properly position the seam lines. This may include tensioning the drawstring 80, as shown in step 93. Specifically, in the illustrated embodiment, the drawstring 80 is tensioned to draw a top of the cover assembly 31 downwardly onto the cushion stiffener 34. This also tensions the front panel 32. The tensioned drawstring 80 helps hold the cover assembly 31 in position during the steps of inserting staples 82 and 83, and during a step of setting any adhesive in the assembly. The front panel 32 is then staple-attached along its upper edge to the cushion stiffener 34 by staples 82 (FIG. 9) that extend through the wrapped-over top edge of the front panel 32 into the cushion stiffener 34. The upper edge 33' of the rear panel 33 is overlapped onto the down flange 76 and is stapled with staples 83 that extend through the upper edge into the down flange 76. Where desired, heat-activated adhesive is applied to a front surface of the topper cushion 73, and the adhesive is activated by steam or heat to adhere the front panel 32 to the topper cushion 73. This assembly results in cushion assembly 28.

The back support shell 27 of the back construction 24 (FIG. 13) is attached in a step 94 to the back frame 22 by screws at the top connection 44 and by pivot studs at the bottom connection 45. A lumbar force adjusting device 95 (FIG. 1) is attached to the back frame 22 to bias the flange 47 of belt bracket 46, such that the lumbar section 43 of the back support shell 27 naturally is biased to a forwardly concave shape.

The cushion assembly 28 is assembled onto the back support shell 27 in a step 96 (FIG. 13) to form the back construction 24 by abutting stops 62' on the cushion stiffener 34 against the stops 62' on the back support shell 27, and by extending the hooks 58 on the thoracic section 41 of the back support shell 27 into the apertures 75 of the cushion stiffener 34. Then, the back cushion 35 including the cushion stiffener 34 is moved downwardly to frictionally engage the hooks 58. Thereafter, the stiffened edge flange 39 at the bottom of the rear panel 33 is stretched, rolled 180 degrees, and tucked upwardly into the downwardly facing horizontal recess 49 on the back support shell 27 (in a step 97). The stiffened edge flange 39 is tucked into position from one side to another with a zip-lock type motion. After it is fully inserted, the side edges of the high-stretch second section 37 are pulled back, and a staple is extended through the stiffened edge flange 39 into each end of the rear lip 50 in a step 98. The high-stretch second section 37 is then pulled laterally out to a wrinkle-free condition where it hides these end-located staples. Notably, the high-stretch second section 37 is a dark or black color and is located behind the seat 23 below the back construction 24 in the shadow of the back construction 24, such that the bottom connection 30 including the enlarged section 48 of the back support shell 27 is not easily visible to a person standing in or around the chair 20.

Figure 11:
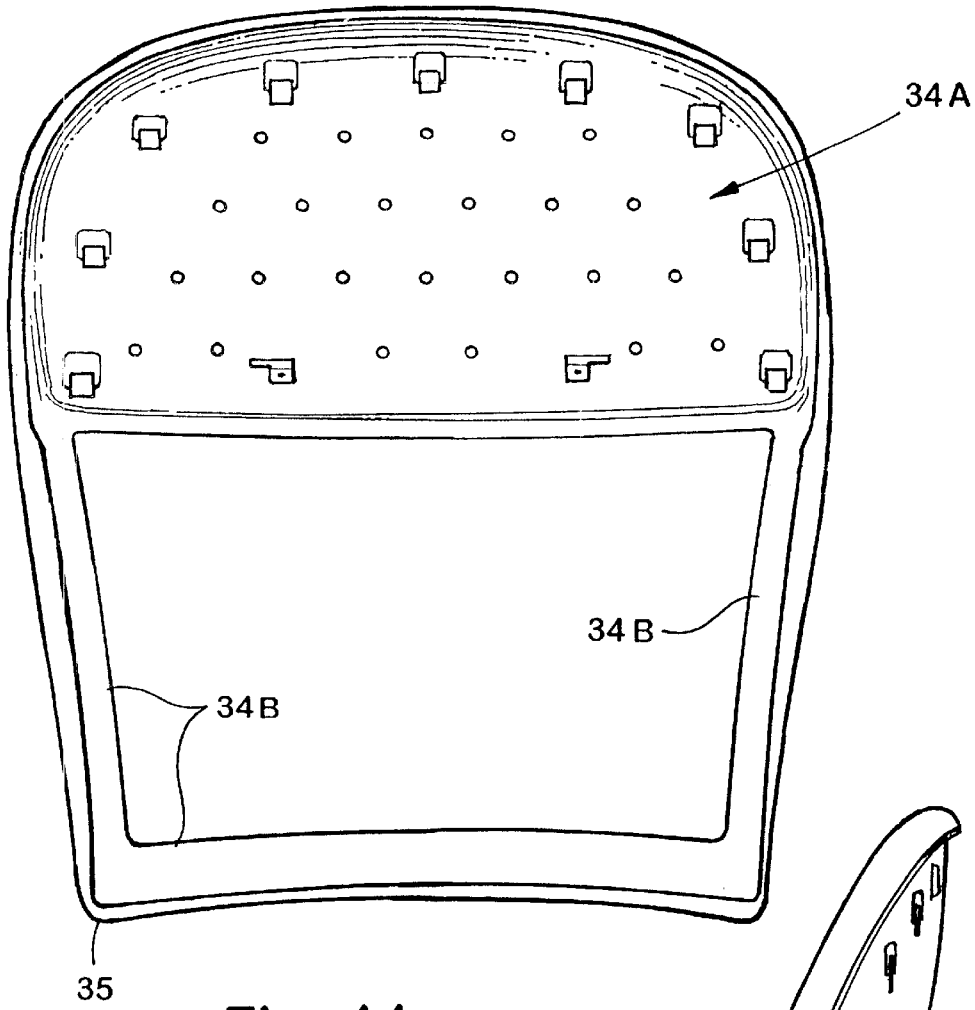
FIG. 11 is a rear view of a modified cushion assembly similar to that shown in FIG. 9, but with edge stiffener legs extending downwardly along side edges of the cushion pad.
Figure 12:
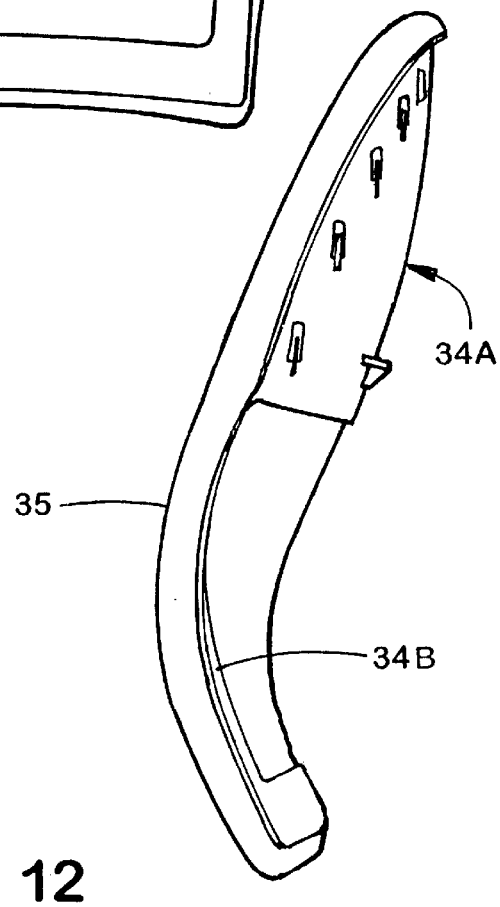
FIG. 12 is a side view of the modified cushion assembly shown in FIG. 11.

In the embodiment of FIGS. 11 and 12, a modified cushion stiffener 34A is provided that includes an upper portion like the stiffener 34, but further includes perimeter bands 34B that extend down side edges and along a bottom of the cushion 35 to stiffen the edges completely around the cushion 35. Cushion stiffener 34A is desirable where the fabric panels 32 or 33 are so strong as to overpower the cushion edges causing wrinkling.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A seating unit comprising:

a back upright adapted to be operably supported on a base for movement between an upright position and an angled position; and a back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the back support including a flexible lumbar section that is constructed to flex between different vertical profiles providing different lumbar support;

the cushion assembly including a back cushion, and further including an aesthetic cover that covers at least a front side of the back cushion; and the back support including hooks and the cushion assembly including apertures for engaging the hooks for assembly.

2. The seating unit defined in claim 1, wherein the recessed channel defines a rectangular shape and the stiffened edge flange is also rectangularly shaped and configured to fit within the recessed channel.

3. The seating unit defined in claim 1, wherein the stiffened edge flange is configured to frictionally engage the recessed channel during assembly with a zipper-like motion from one end of the stiffened edge flange to the other end.

4. The seating unit defined in claim 3, wherein staples are engaged with ends of the stiffened edge flange to retain the stiffened edge flange in the recessed channel.

5. The seating unit defined in claim 1, wherein the cushion assembly includes a back cushion, and further includes a cushion stiffener attached to the back cushion.

6. The seating unit defined in claim 1, wherein the back support is attached to the back upright by fasteners that extend in a rearward direction through the back support into the back upright.

7. The seating unit defined in claim 1, wherein the cushion assembly is constructed to be assembled onto the back cushion to cover the back cushion.

8. The seating unit defined in claim 1, including a base comprising a pedestal and castors on the pedestal, the base operably supporting the back upright.

9. A seating unit comprising:

a back upright adapted to be operably supported on a base for movement between an upright position and an angled position; and a back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the cushion assembly including a back cushion, and further including a cushion stiffener attached to the cushion, the cushion stiffener including downwardly extending strips of material that stiffen lower side edges of the back cushion for edge support.

10. The seating unit defined in claim 9, including a base comprising a pedestal and castors on the pedestal, the base operably supporting the back upright.

11. A seating unit comprising:

a back upright adapted to be operably supported on a base for movement between an upright position and an angled position; and back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the cushion assembly including a back cushion, and further including a cushion stiffener attached to the back cushion, the cushion assembly including a cover assembly comprising a pull-on sock, and wherein the pull-on sock is stapled to the cushion stiffener after assembly.

12. The seating unit defined in claim 11, wherein the cover assembly includes a wrapped top edge that is stapled along a top edge of the cushion stiffener, and further includes an overlapped second edge stapled to a bottom of the cushion stiffener.

13. The seating unit defined in claim 12, wherein the wrapped top edge of the cover assembly includes a drawstring attached to the wrapped top edge that is tensioned and stapled to the cushion stiffener.

14. The seating unit defined in claim 11, including a base comprising a pedestal and castors on the pedestal, the base operably supporting the back upright.

15. A seating unit comprising:

a back upright adapted to be operably supported on a base for movement between an upright position and an angled position; and a back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the cushion assembly including a back cushion, and further including a cover assembly constructed to be inverted and assembled onto the back cushion to cover the back cushion;

wherein the cover assembly including a front panel covering a front surface of the back cushion, and further including a rear panel that covers a rear surface of the back cushion, the rear panel including fabric that characteristically stretches in a vertical direction at a rate of at least about twice an elongation of the fabric in a horizontal direction.

16. The seating unit defined in claim 15, including a base comprising a pedestal and castors on the pedestal, the base operably supporting the back upright.

17. A seating unit comprising:

a back upright adapted to be operably supported on a base for movement between an upright position and an angled position; and a back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the cushion assembly including a back cushion, and further including a cover assembly constructed to be inverted and assembled onto the back cushion to cover the back cushion;

the cover assembly including a lower panel attached to a bottom edge of the rear panel, the lower panel including high-stretch material that elongates at least about 100 percent in a vertical direction, the lower panel including material forming the stiffened edge flange.

18. The seating unit defined in claim 17, including a base comprising a pedestal and castors on the pedestal, the base operably supporting the back upright.

19. A seating unit comprising:

a back upright adapted to be operably supported on a base for movement between an upright position and an angled position; and a back construction including a back support attached to the back upright, and further including a cushion assembly attached to the back support, the back support including a bottom section, and the cushion assembly including an elastically stretchable lower edge section stretched and attached to the bottom section of the back construction to pull a lower part of the cushion assembly downwardly, the cushion assembly further including a back cushion and a cushion stiffener, the cushion stiffener including downwardly extending strips of material that stiffen the back cushion for edge support.

20. The seating unit defined in claim 19, including a base comprising a pedestal and castors on the pedestal, the base operably supporting the back upright.

21. A seating unit comprising:

a back upright adapted to be supported on a base;

a back support including relatively stiff thoracic and pelvic sections pivoted to the back upright at top and bottom connections, respectively, and further including a flexible lumbar section located between the thoracic and pelvic sections, the back support including a first top connector and a first bottom connector; and a cushion assembly covering at least part of a front surface of the back support, the cushion assembly including a second top connector engaging the first top connector on the back support and including a second bottom connector engaging the first bottom connector on the back support, one of the first top and bottom connectors including a horizontally extending recessed channel and one of the second top and bottom connectors including a stiffened edge flange configured to frictionally engage the recessed channel to retain the cushion assembly to the back support at a bottom thereof, the other of the first top and bottom connectors including at least one aperture and the other of the second top and bottom connectors including at least one hook engaging the at least one aperture.

22. The seating unit defined in claim 21, including a base comprising a pedestal and castors on the pedestal, the base operably supporting the back upright.

23. A seating unit comprising:

a back upright adapted to be operably supported on a base for movement between an upright position and an angled position; and a back construction including a back support attached to the back upright, and further including a cushion assembly attached to the back support, the back support including a bottom section defining a horizontally extending recessed channel, and the cushion assembly including a stiffened edge flange configured to frictionally engage the recessed channel to retain the cushion assembly to the back support along the bottom section of the back construction, the back support including hooks and the cushion assembly including a cushion stiffener with apertures for engaging the hooks for assembly.

24. The seating unit defined in claim 23, including a base comprising a pedestal and castors on the pedestal, the base operably supporting the back upright.

* * * * *